US007402188B2

(12) United States Patent
Sprouse

(10) Patent No.: US 7,402,188 B2
(45) Date of Patent: Jul. 22, 2008

(54) METHOD AND APPARATUS FOR COAL GASIFIER

(75) Inventor: Kenneth M. Sprouse, Northridge, CA (US)

(73) Assignee: Pratt & Whitney Rocketdyne, Inc., Canoga Park, CA (US)

( * ) Notice: Subject to any disclaimer, the term of this patent is extended or adjusted under 35 U.S.C. 154(b) by 528 days.

(21) Appl. No.: 10/931,061

(22) Filed: Aug. 31, 2004

(65) Prior Publication Data

US 2006/0045827 A1 Mar. 2, 2006

(51) Int. Cl.
*C10J 3/68* (2006.01)
*B01J 8/00* (2006.01)
*B01J 8/04* (2006.01)

(52) U.S. Cl. ..... 48/77; 422/188; 422/198; 422/207; 422/232; 422/234; 422/241

(58) Field of Classification Search ..... 48/77, 48/197 R; 422/139, 141, 142, 145, 146, 422/147, 187, 188, 198, 207, 232, 234, 240, 422/241, 242
See application file for complete search history.

(56) References Cited

U.S. PATENT DOCUMENTS 3,856,658 A 12/1974 Wolk et al.
3,954,389 A 5/1976 Szetela
4,191,500 A 3/1980 Oberg et al.
4,197,092 A 4/1980 Bretz
4,206,610 A 6/1980 Santhanam
4,347,064 A * 8/1982 Reh et al. ..... 48/197 R
4,356,078 A 10/1982 Heavin et al.
4,362,500 A 12/1982 Eriksson et al.
4,377,356 A 3/1983 Santhanam
4,391,561 A * 7/1983 Smith et al. ..... 414/218
4,426,810 A * 1/1984 Rudolph et al. ..... 48/197 R
4,488,838 A 12/1984 Herud
4,721,420 A 1/1988 Santhanam et al.
5,226,936 A * 7/1993 Garkawe ..... 55/434.4
5,558,473 A 9/1996 Lindahl
6,152,668 A 11/2000 Knoch
6,220,790 B1 4/2001 Schenk et al.
6,418,973 B1 * 7/2002 Cox et al. ..... 139/383 R

OTHER PUBLICATIONS

U.S. Appl. No. 09/954,753, filed Sep. 2001, Marshall et al.
U.S. Appl. No. 10/271,950, filed Oct. 2002, Sprouse et al.
K. M. Sprouse and M. D. Schuman, Dense-Phase Feeding of Pulverized Coal in Uniform Plug Flow, Nov. 1983, pp. 1000-1006 and reference page.

* cited by examiner

*Primary Examiner*—Glenn Caldarola
*Assistant Examiner*—Randy Boyer
(74) *Attorney, Agent, or Firm*—Carlson, Gaskey & Olds

(57) ABSTRACT

A method and apparatus for efficiently forming a gaseous material from a solid starting material. The produced gaseous material includes a CGE HHV having a high percentage of an original HHV of the starting material. The gaseous product may be used to form a plurality of materials for various purposes.

29 Claims, 2 Drawing Sheets

METHOD AND APPARATUS FOR COAL GASIFIER

FIELD

The present disclosure relates generally to processing coal, and particularly to forming a selected material from a coal precursor.

BACKGROUND

Since electricity and electrically powered systems are becoming ubiquitous, it has become increasingly desirable to find sources of power. For example, various systems may convert directly various petrochemical compounds into electrical energy. Further, petrochemical compounds are used to create various materials, such as steam, which are used to drive steam powered turbines.

Various petrochemical compounds and forms, such as coal, petroleum, and the like may be used to power various systems or produce heat to create steam. Various sources of certain compounds are expensive or difficult to extract and require complex machinery to process. Therefore, it is desirable to provide systems that are operable to produce various compounds, either synthetics of generally known compounds or alternatives thereto to produce the selected heat energy or electrical energy.

SUMMARY

The present disclosure relates to a system to gasify coal in a gasification process that provides for an efficient transfer of a coal heating value to a gas of similar heating value. For example, a system may be provided to create at least a 90% or greater cold gas efficiency (CGE). Generally, CGE is the higher heating value (HHV) of the produced gas, such as synthesis gas, divided by the HHV of the coal or petcoke. Synthesis gas may include hydrogen gas and carbon monoxide and other compounds. The system may also produce a 93% or higher CGE according to various embodiments.

According to various embodiments a system to produce a gaseous product from a solid starting material is disclosed. The system may include a starting material supply, a first gasification subsystem, and a second gasification subsystem. Also, a pump system may provide a volume of the solid starting material from the starting material supply and operable to form a dry slurry of the solid starting material with a slurry material. A starting material recycling system may be used to increase the efficiency of the system or other appropriate purposes. A cyclone separator interconnecting the first gasification subsystem and the second gasification subsystem may remove a volume of a solid material from a stream of gas produced by the first gasification subsystem prior to the stream passing to the second gasification subsystem. The pump increases a pressure of the solid starting material to a pressure greater than an ambient pressure.

According to various embodiments a system for forming a gas of a solid material is disclosed. The system may include a pressurizing sub-system with a pump operable to form a dry slurry of the solid material with a slurry material to pressurize the solid material and a solid material supply to provide a selected volume of the solid material to be pressurized in the pressurizing system. Also a first sub-system to process the solid material to a first product having a temperature greater than about 1300° C. may be used with a second sub-system to process the first product to a second product having a temperature less than about 950° C. A separation system may remove a solid material from the first product formed by the first subsystem. The system may also include a solid material recycle subsystem that is operable to provide a portion of the solid material unprocessed in the first subsystem or second subsystem for reprocessing in at least one of the first subsystem or the second subsystem.

According to various embodiments a method of forming a gas from a solid material including a first and a second gasification system is disclosed. The method may include pressurizing the solid material to a first pressure that may be performed by forming a slurry of the solid material with a non-aqueous material to form a slurry to be pressurized. A first portion of the solid material may be gasified to form a product at a first temperature and the product may be processed to a second temperature. Adding a second portion of the solid material may assist in forming the second temperature. Both a selected material and an unprocessed material may be removed from the product. The unprocessed material may be gasified with a first portion of the solid material.

Further areas of applicability of the present teachings will become apparent from the description provided hereinafter. It should be understood that the description and various examples, while indicating various embodiments are intended for purposes of illustration only and are not intended to limit the scope of the teachings.

BRIEF DESCRIPTION OF THE DRAWINGS

The present invention will become more fully understood from the detailed description and the accompanying drawings, wherein.

DESCRIPTION OF VARIOUS EMBODIMENTS

The following description of various embodiments is merely exemplary in nature and is in no way intended to limit the present teachings, its application, or uses.

Figure 1:
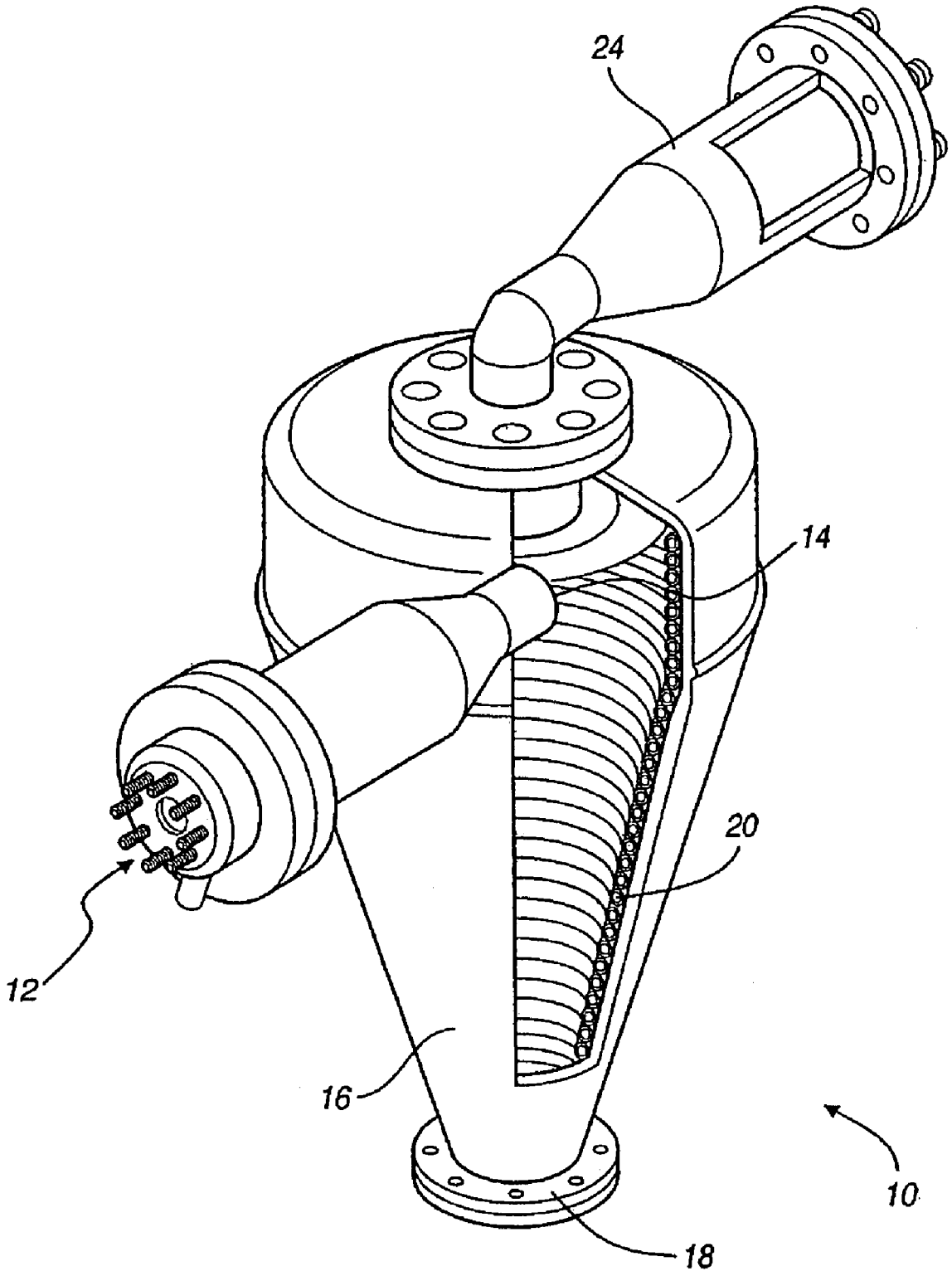
FIG. 1 is a detail view and partial cross-section of a two-stage coal gasifier.

With reference to FIG. 1, a two-stage coal gasifier and cyclone separating the system (two-stage gasifier) 10 is illustrated. As described herein, the two-stage gasifier 10 may be used with a system to form a selected gas product, such as raw synthesis gas, at a selected pressure, temperature, and other physical properties. It will be understood that synthesis gas may be a mixture of any appropriate gas products, such as hydrogen ($H_2$) gas and carbon monoxide (CO) gas. The hydrogen and carbon monoxide gas, may be used for various purposes, such as synthesizing selected petrochemicals, hydrocarbons, and the like. The gas produced by the two-stage gasifier 10 may be used to power various systems, such as turbines. Also the properties of the produced gas itself may be used in a more direct way such as being expanded to provide a source of thermal heat and other appropriate energy sources.

The two-stage gasifier 10 generally includes a first stage gasifier section 12. The first stage gasifier 12 allows for input of a selected product, such as coal, char (recycled coal), petcoke and other appropriate materials, such as those described herein. In addition, various input compounds may further include steam or water and oxygen to assist in the first gasification stage. The first stage gasifier 12, therefore, includes a plurality of inlets to offer input of the various components. In the first stage gasifier 12, various injectors may be used to inject the materials and provide a heat source to ignite the materials in the oxygen and steam atmosphere. In the first stage gasifier 12, it may be desirable to produce various temperatures and flow rates. Generally, the first stage gasifier may provide an exit temperature of about 1315° C. to about 1760° C. (about 2400° F. to about 3200° F.). It will be understood that any appropriate temperature either above 3200° F. or below 2500° F. may be formed in the first stage gasifier 12 as desired. Nevertheless, various feed materials may degrade faster at a temperature higher than 3200° F. and a selected amount of gasification may not occur below about 2500° F. Although, the two-stage gasifier 10 and a system into which it is incorporated may be altered to require or allow for temperatures outside of range of 2500° F. to about 3200° F.

The first stage gasifier 12 has an outlet 14 into a cyclone separator 16. The cyclone separator 16 allows for a moving or separation of the materials injected into the cyclone separator 16 from the first gasifier 12, such that various components may be removed from the stream. As described herein various components or slag may exit through an outlet 18 to be recovered for various uses. The slag may include trace amounts of ungasified components of the char and coal input into the first gasifier 12 and other various byproducts that are not carried further through the system. Therefore, the slag may exit through the outlet 18 while the gasified components may move into a second stage gasifier 24. The cyclone 16 may be protected through any appropriate materials, such as ceramic bricks an or active cooling systems 20, such as those described herein and in U.S. patent application Ser. No. 10/677,817, filed Oct. 2, 2003, entitled "REGENERATIVELY COOLED SYNTHESIS GAS GENERATOR" incorporated herein by reference. Various ceramic matrix composite (CMC) active cooling systems 20 may be used as a cyclone liner so that the slag may exit through the outlet 18 and the gasified products enter the second gasifier 24 without compromising the integrity of the cyclone 16.

Nevertheless, once the gasified products enter the second gasifier 24 additional inputs may be provided. For example, an additional volume or mass of coal or petcoke may be added to the second gasifier stage 24. As is understood in the art, this may cause a quenching of the gasifying process and may cool the temperature of the second stage gasifier 24 to a temperature less than that of the exit temperature of the first gasifier 12 and the cyclone 16. For example, the temperature of the material exiting the second stage gasifier 24 may be about 871° C. to about 982° C. (about 1600° F. to about 1800° F.), such as about 954° C. (about 1750° F.). As discussed above, the temperatures of the material exiting the second stage gasifier 24 may be any appropriate temperature, and about 871° C. to about 982° C. is merely exemplary. For example, various materials or systems may require or be advantageously operated at temperatures either below or above this range. Further, the gas exiting the second gasifier 24 may include various and selected components due to the selected temperature range. For example, although the gas exiting the first gasifier stage 12 may be substantially carbon monoxide and hydrogen gas, such as greater than about 85 vol %, temperatures of the gas below about or at about 1700° F. may produce or allow a formation of methane at about 2% to about 10%, or about 3%, of the volume of the gas. Therefore, various temperature ranges may be formed in the gas flow stream to form a gas of a selected composition.

Figure 2:
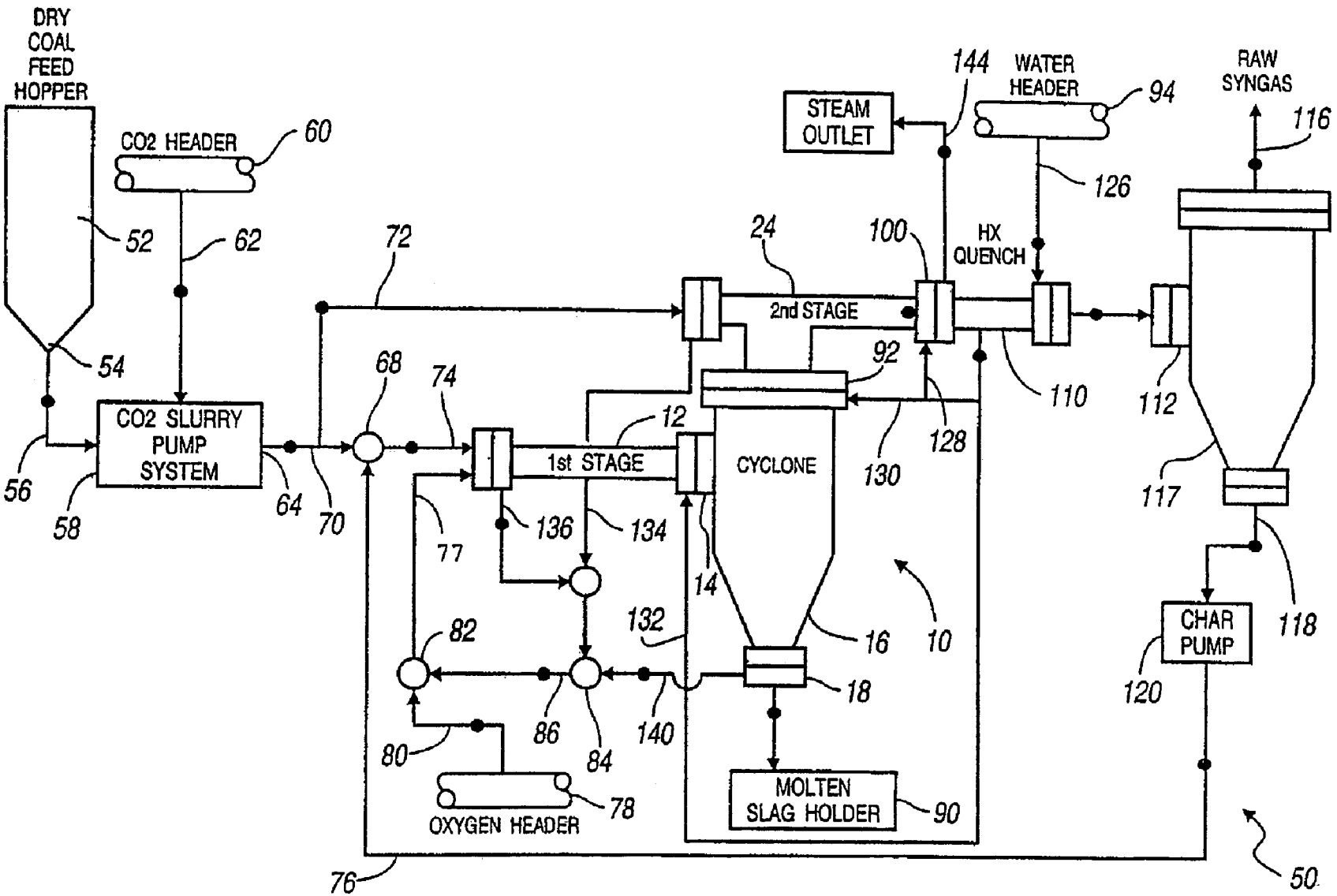
FIG. 2 is a diagrammatic view of a coal gasification system.

The two-stage gasifier 10 may be used in any appropriate system to form a selected product, such as gasification of coal or petcoke into a material, such as synthesis gas. Although these systems using the two-stage gasifier 10 may be any appropriate system, a system according to various embodiments is diagrammatically illustrated in FIG. 2. A coal gasification or synthesis gas production system 50 is illustrated in FIG. 2. It will be understood that the gasification system 50 is merely exemplary and is not limiting. Further, the gasification production system 50 may be used in a plant to form a product having an efficiency of the CGE of the input coal to greater than about 90%.

The gasification system 50 may gasify any appropriate material, such as coal. Any appropriate coal from various sources may be used in the gasification system 50. Further, material such as petcoke and other solid carbonateous materials may be used in the formation of the selected material, such as the synthesis gas. The system 50 includes a coal or carbonateous material hopper 52. It will be understood that the coal hopper 52 may hold any appropriate material and include an outlet 54 for selectively providing the material held in the coal hopper 52 to the remaining portions of the system 50.

The coal from the coal hopper 52 can be provided along line 56 to a pump system 58. The line 56 is illustrated diagrammatically and will be understood to be any appropriate line system. Further, it will be understood that the lines described herein may be any appropriate lines to provide the material from its origin to a selected destination. Therefore, the line 56 is provided to exemplary show an interconnection between the coal hopper 52 and the pump system 58. The coal may be fed from the coal hopper 52 at any selected or appropriate rate produced by the coal pump system 58. For example, the coal may be fed at a rate of about 46 pounds per second. Although it will be understood that the coal may be provided at any appropriate rate, such as about five pounds per second to about two hundred pounds per second. Although any appropriate rate may be provided higher or lower than this range depending upon the system 50 and any portion to which it may be interconnected. Therefore, the flow rate of the coal from the coal hopper 52 is merely exemplary and provided for the teachings herein.

The system 58 may include any appropriate coal pump system. For example, the coal pump system may be a substantially dry system that forms a dry slurry of the coal from the coal hopper 52 with a volume of $CO_2$. Therefore, the coal pump system 58 need not mix the coal with a liquid, such as water, to pump the coal into the remaining portions of the system 50 or to any portion of the system 50 to which it may be connected. The coal pump system 58, including the $CO_2$ slurry system, may further include a $CO_2$ header or supply 60. The $CO_2$ from the $CO_2$ supply may be provided along line 62 to the coal pump system 58 at any appropriate rate or pressure. For example, the $CO_2$ may be provided from the $CO_2$ supply 60 at about one to about five pounds per second, and may be provided at about 2.7 pounds per second from the $CO_2$ supply 60 to the coal pump system 58.

The coal pump system 58 may be any appropriate coal pump system. For example, the coal pump system may be similar to the system described in U.S. patent application Ser. No. 10/271,950, filed Oct. 15, 2002, entitled "METHOD AND APPARATUS FOR CONTINUOUSLY FEEDING AND PRESSURIZING A SOLID MATERIAL INTO A HIGH PRESSURE SYSTEM", incorporated herein by reference (although any portion of the application incorporated herein by reference, which is contrary to the present application, the present application will be understood to control). Further systems that may be provided as the coal pump system 58 may include the Stamet rotary disk pump provided by Stamet, Inc. of North Hollywood, Calif. Regardless of the specific system provided for the coal pump 58, the coal pump 58 may move the coal from the coal hopper 52 in a selected slurry, such as a slurry of $CO_2$, in a substantially dry or water free manner to the system 50. It will be understood that a selected amount of water or moisture may be provided in the coal or other portions of the system, but the pump system 58 may form a dry slurry of the coal from the hopper 52 and not form a water slurry with the coal. Further, an outlet 64 can be provided from the coal pump system 58.

The outlet 64 can provide or outlet the coal from the coal pump system 58 in any appropriate physical conditions. For example, the coal slurry may exit the outlet 64 at a pressure of about 500 psia to about 1400 psia, such as about 1200 psia. Further, the pressurization of the coal in the pump system 58 may raise the temperature of the coal slurry to about 87° C. to about 93° C. (about 190° F. to about 200° F.). It will be understood that any appropriate pressure may be formed in the pump system 58. For example, a plurality of pumps may be provided in series to sequentially increase the pressure of the coal slurry to a selected pressure of, for example, about 1200 psia. Regardless, it will be understood that any appropriate pressure of the coal slurry may be provided at the outlet 64 of the coal pump system 58. Simply, the exemplary pressures are provided for the discussion herein.

For example, higher pressures may be used downstream to power additional systems, such as expansion heaters or heat exchangers. The higher pressures may be used to directly power various turbines. In addition, higher pressures may be used to provide for easy transport of the product formed by the system 50, such as synthesis gas. The higher pressures may be commercially advantageous for such systems as supplying or supplementing octane in fuels, forming alcohols, forming pure hydrogen gas, and other appropriate systems. Further, the high pressure product may be selectively depressurized to power various systems, such as heat exchangers, expansion turbines, and the like. Therefore, the overall efficiency of the system 50 and a plant into which the system 50 may be provided can increase the efficiency of the plant As discussed above, the two-stage gasifier 10 forms a part of the system 50 for forming a gas from a selected component, such as coal that may be provided from the coal hopper 52. The two-stage gasifier 10 includes the first stage gasification 12 and the second stage gasification 24 interconnected through a cyclone separator 16. To be described further herein, char may be formed during the gasification of the coal. The char can be recycled through the system to further remove and gasify material from the coal. Therefore, the coal from the coal pump 58 and char can mix in a mixing area or mixer 68.

The mixer 68 may be any appropriate pipe section. For example, mixer 68 may include a powered mixing system to mix the new coal or fresh coal from the coal pump 58 and the recycled char. Alternatively, or in addition thereto, the mixing section 68 may simply provide an area for collection in non-active mixing of the fresh coal with the char. Regardless, the mixing section 68 allows for intermingling and providing the char to the first stage gasifier 12 with the fresh coal that is provided through the coal pump 58.

The fresh coal provided directly out of the coal pump 58 can generally be provided at a flow rate of about 49 pounds per second through line 70. A portion of the fresh feed from the pump 58 may be diverted through a diversion or second stage feed line 72. In the second stage feed line, the flow may be about 20 to about 25 pounds per second, such as about 23 pounds per second or even at about 22.6 pounds per second.

In the mixing area 68, the remaining portion of the new or fresh coal from the coal pump 58 is provided through a line 74, after it is mixed in the mixing section 68, with the char provided from line 76. The char in the line 76 may be provided at a flow rate of about 5 to about 9 pounds per second, such as about 7.8 pounds per second As discussed herein, the char can be pressurized to the high system pressure of about 500 psia to about 1400 psia. Since the char is already produced near the elevated gasifier pressure, the char recycle feed 118 may be pressurized (after displacing the entrained synthesis gas with carbon dioxide) using a commercially available piston-diaphragm pump such as the GEHO pump manufactured by the Weir Group, Netherlands. The material in the line 74 may then be provided at a flow rate of about 30 to about 37 pounds per second, such is about 34.2 pounds per second. As discussed above, the pressure from the pump 58 and the high pressure of the system 50 may provide that the coal material, including the new or fresh coal and the char, at a pressure through the line 74 at about 500 psia to about 1400 psia.

Through a second inlet line 77 oxygen may be provided from an oxygen supply 78. The oxygen provided from the oxygen supply 78 can be provided along line 80. The oxygen alone line 80 may be provided at any appropriate flow rate, such as about 25 to about 30 pounds per second, or such as about 28.5 pounds per second. Further, the oxygen may be provided at any appropriate temperature, such as about 260° C., to about 482° C. (about 500° F., to about 900° F.). Further, the oxygen provided through the line 80 may be pressurized to the pressure of the system, such as about 500 psia to about 1400 psia. It will be understood, however, that the various flow rates, pressures, and temperatures of the oxygen provided through the line 80 may be altered depending upon the system 50 or the operation of the system 50 with another selected system.

Further, a mixing section 82 may be provided to mix with the oxygen provided from the oxygen supply 78 with steam provided from a steam mixer 84 through a steam line 86. As discussed herein, steam may be produced in various areas of the system 50 or may be provided by a boiler for injection into second inlet line 77. The steam injected from the steam mixer 84 to the line 86, and provided to the mixing section 82, may be provided at any appropriate flow rate. The flow rate of the steam may be about 25 to about 29 pounds per second, and such as about 27.8 pounds per second. The temperature of the steam provided in line 86 may be provided at about 537° C. to about 760° C. (about 1000° F. to about 1400° F.). Further, the pressure of the steam in line 86 to the mixer 82 may be similar to the pressure of the system, such as about 500 psia to about 1400 psia. It will be understood that the flow rate, pressures, temperatures, and the like may be provided in any appropriate range or number to provide a result from the system 50 as selected. For example, the system 50 may be operated at a lower pressure for achieving selected results or characteristics of the product. Alternatively, higher pressures and temperatures may be used to select a particular efficiency, characteristic, and the like for the system 50.

As discussed above, the two-stage gasifier 10 includes the first stage gasification system 12. The gasification system 12 may be any appropriate gasification system that is compact and produces a high speed (approximately 200 ft/sec) liquid/gas flow for connection to the inlet of the cyclone separator. The gasification system 12 may contain a liner (such as the CMC liner described in U.S. patent application Ser. No. 10/677,817) which is capable of withstanding the abrasive and corrosive environment of such as a high temperature and high speed gas flow containing molten slag and sulfur gas compounds such as H2S and COS. The gasification system 12 generally provides a mechanism and environment to gasify the coal provided through the coal pump 58 and any char provided through line 76. The operating temperatures of the first stage gasifier 12 may be any appropriate temperature, such as those discussed above. Regardless, it will be appreciated that the temperatures of the first stage 12 may be greater than about 1204° C. (about 2200° F.). As discussed above, the operating temperature of the first stage 12 may, however, be maintained below about 1760° C. (about 3200° F.) for various operational reasons, such as longevity.

The gasified product or the product exiting the first stage through the gasification outlet 14 enters the cyclone separator 16. In the cyclone separator 16, the molten slag, which can include metal oxides and silicates (such as alkali, alkali earth, and transition metal oxides and silicates), may be emptied from the outlet 18 to a molten slag holder 90. The molten slag holder 90 may be any appropriate system, such as a water quench or heat resistant container. Generally, the slag exits the cyclone separator 16 at a rate of about 3 to about 5 pounds per second, such as about 4.8 pounds per second. The molten slag can be heated to a temperature, including any appropriate temperature, such as greater than about 1204° C. (about 2200° F.). It is understood by one skilled in the art that the slag material may include various elements that may be contained within a solidified ash product. By providing the molten slag at a temperature above about 1204° C. (about 2200° F.) the molten slag provided to the molten slag holder 90 may be used safely in various applications, such as landfill, road bed fill, and the like. Therefore, because the first gasification stage system 12 allows for formation of temperatures greater than about 1204° C. the molten slag provided to the molten slag holder 90 is generally usable in selected applications.

Further, the cyclone separator 16 provides a gas stream out of the cyclone separator 16 to the inlet 92 of the second stage system 24 that is generally about 99 wt % pure gas (corresponding to a slag removal efficiency of 90 wt %) from the gasification in the first gasification stage 12. It will be understood that the gas provided to the second stage gasification system 24 may include any appropriate percentage of slag, depending upon the operation of various components and the efficiencies of the cyclone separator 16. Regardless, the gas (that may include a fraction of slag) is provided to the inlet 92 of the second stage gasification system 24 including less than about 1 wt % slag.

Further, as discussed above, fresh coal may be provided through line 72 to the second stage gasification system 24. The provision of the coal to the second stage gasification system 24 may allow for a complete gasification of the material provided to the second gasification stage system 24. Further, the coal provided along line 72 may provide a quenching of the material in the second stage gasification system stage 24.

The provision of the fresh coal may substantially cool the temperature of the material provided to the inlet 92 of the second stage gasification system 24. As discussed above, the material exiting the first stage gasification system 12 is generally greater than about 2200° F. The temperature of the material exiting an outlet 100 of the second stage gasification system 24, however, may be provided at a temperature of about 815° C. to about 1037° C. (about 1500° F. to about 1900° F.), such as about 954° C. (about 1750° F.). Therefore, the quenching in the second stage gasification system 24 can substantially cool the temperature of the material as it exits or before it exits the second stage gasification system 24. Regardless, the product exiting the outlet 100 of the second stage gasification system 24 can still include a pressure of about 500 psia to about 1200 psia, such as about 1000 psia. Further, the flow of the material from the outlet 100 may be about 100 to about 120 pounds per second, such as about 108.2 pounds per second.

The material exiting the second stage gasification system 24 at the outlet 100 may include substantially synthesis gas, which can have various compositional breakdowns. Nevertheless, the product exiting the second stage gasification system 24 through the outlet 100 may be about 85 to about 98% synthesis gas, such as about 93% synthesis gas. The synthesis gas may include a plurality of components, such as methane, hydrogen, water vapor, and other various components. At the temperatures of the outlet 100, the synthesis gas may include about two to about four volume percent of methane, such as about 3.26 volume percent methane. Further, carbon monoxide, carbon dioxide, hydrogen gas and water may form a majority of the synthesis gas.

It will be understood that the composition of the synthesis gas exiting the outlet 100 may be exemplary and actual amounts may differ from the theoretical calculations. Regardless, a portion of the synthesis gas provided the outlet 100 may include methane, carbon monoxide, carbon dioxide, and hydrogen gas. Further, the char provided from the outlet 100 may include a higher heat value (HHV) of about 9000 to about 10000 BTUs per pound, such as about 9820 BTUs per pound. Note this char is produced from the coal provided in the hopper 52 that may have an initial higher heat value of about 12360 BTUs per pound. The chemical energy of the product synthesis gas exiting outlet 100 will retain over 90% of the HHV of the coal in the gasification system 50, according to various embodiments.

The material from the outlet 100 can be provided to a quencher or heat exchanger 110 that is operable to cool the temperature of the material a selected amount. For example, the heat exchanger 110 may cool the material from the exit temperature from the outlet 100 to a temperature of about 260° C. to about 537° C. (about 500° F. to about 1000° F.), such as about 426° C. (about 800° F.).

The quenched material may then be provided through a filter 112, such as a selected ceramic or metal filter. The filter 112 may be any appropriate filter, such as the candle filter modules manufactured by the Pall Corporation of Timonium, Md. The filter 112 may allow for removal of various portions from the synthesis gas, such as the unreacted char produced from the line 72 coal feed and the slag that was not removed from by cyclone 16. Therefore, the filters 112 may provide for a substantially purer or cleaner synthesis gas to exit the system 50 through outlet line 116. The gas stream may pass through a collector 117 where the back pressure through the filters may drive the char so that it may be recycled. The back pressure gas may be $CO_2$ or any appropriate gas. Also, $CO_2$ may be used in the collector to assist in removing any product gas caught in the interstices of the char particles. The $CO_2$ may move the particles to allow for release of the product gas and not interfere with the recycle system for the char.

The raw gas exiting the system 50 may exit the system at any appropriate pressure and temperature. Nevertheless, the various systems may be provided to allow for the exit of the raw synthesis gas through outlet line 16 at a flow rate of about 98 pounds per second to about 102 pounds per second, such as about 100 pounds per second. Further, a temperature of the raw gas exiting the line 116 may be about 315° C. to about 537° C. (about 600° F. to about 1000° F.), such as about 426° C. (about 800° F.). Further, the raw material exiting the line 116 may have a pressure of about 500 psia to about 1200 psia, such as about 1000 psia. As discussed above, the pressure of the gas exiting the system 50 may be expanded to power various further generating systems or may be provided for various uses at the high pressure.

The filter 112 may be periodically cleared with a back pressure of $CO_2$, which may be provided from the $CO_2$ supply 60, or other appropriate material. The filters may be rotated between a primary and a cleaning filter, such that the back pressure may remove the particulates, such as the char and slag from the filters. The clearing may allow for efficient use of the primary filter and it may be reinstalled for efficient use thereof. Therefore, the filters 112 may be substantially non-sacrificial or non-reactive and be provided to remove the material from the gas produced by the system 50.

As discussed above, char may be provided in a recycle system to allow it to further be gasified in the two-stage gasifier 10 that may be part of the gasification system 50 if it is not gasified during its first pass. Therefore, the char may be provided first along line 118 to a char pump system 120. The char pump system 120 may be any appropriate pump system, such as the pump system used for the coal pump system 58. Regardless, the char pump system 120 may provide the char through the line 76 to the mixing area 68 as discussed above.

In addition to or as part of the gasification system 50 described above, a cooling system and steam generation system may also be provided. It will be understood that the cooling and steam generation system may be substantially integral with the system 50. The cooling system may provide steam and water for the gasification system 50. A water supply 94 provides water along line 126 to the quench system 110. The quench system 110 may be a heat exchange system to cool the material from the outlet 100 before it enters the filters 112, thereby heating the water provided to the quench system 110 through line 126. Therefore, the water may exit the quench system 110 at a heated temperature.

The water may exit the quench system 110 to various lines to provide cooling or steam to selected systems. The water may exit the quench system 110 along a first line 128 to provide cooling to the outlet of the second stage gasification system 24. Further, water or steam may be provided along a second line 130 to the outlet of the cyclone 16. Water or steam may also be provided along line 132 to the outlet of the first stage gasification system 12. Also, water or other coolant may travel though the coolant outlet lines which are: line 134 from the second stage system, line 136 from the first stage gasification system, and line 140 from the cyclone system. The coolant in these lines may be provided to the steam mixer 84 for injection into the first stage gasification system 12.

As noted, the cyclone system 16 may include an active cooling system. The active cooling system may be in addition to a heat shielding or protection wall. The active cooling system may include channels or tubes in the cyclone 16. A coolant material may be provided in the tubes to actively cool the inner surface of the cyclone 16 to assist maintaining a structural integrity of the cyclone 16. The tubes may form a barrier between the interior of the cyclone 16 and the outer structural wall and be cooled with a coolant provided therein. Various systems include tubes or channels formed of a ceramic matrix composite (CMC) that may provide a circulation within the cyclone 16. Various CMC cooling systems include those disclosed in U.S. patent application Ser. No. 10/677,817, entitled "Regeneratively Cooled Synthesis Gas Generator", filed Oct. 2, 2003, incorporated herein by reference.

The tubes formed of the CMC material may line the cyclone 16 and a coolant, such as steam or water, may be passed therethrough to cool the tubes and not allow the external structure of the cyclone to reach various temperatures. The tubes may actually form the internal surface of the cyclone 16, such that the outer or super structure of the cyclone 16 does not reach a temperature, which may cause a structural heating.

It will be understood, however, that various other systems may be provided to insulate the super-structure or outer structure of the cyclone 16 from the heat of the material from the first gasification stage 12 after it enters the cyclone 16. For example, various heat resistant bricks or ceramic materials may be used to line the internal surface of the cyclone 16. Nevertheless, the CMC tubes may be used to not only cool the internal surface of the cyclone 16, but to provide a steam along a line 140 to the steam mixer 84 for injection into the first stage gasification system 12. Therefore, the system 50 may not only recycle char from the gasification process, but may also regeneratively create steam for use in the gasification process.

Further, as the material from the outlet 100 of the second stage 24 enters the quench system 110 it may be cooled with the water provided from the water supply 94. During this cooling, the heat may be transferred to the water through a heat change system and be provided along a line 144. The steam or water provided along the line 144 may be super heated steam and at a substantially high pressure due to the cooling of the material from the outlet 100. As discussed above, the heat exchange may cool the product material to about 427° C. to about 538° C. (about 800° F. to about 1000° F.). Therefore, the water provided along line 144 may be substantially super heated and at a high pressure. The water flowing along line 144 may be provided at any appropriate flow rates and include a temperature that may be about 538° C. to about 760° C. (about 1000° F. to about 1400° F.), such as about 649° C. (about 1200° F.). Further the water in the line 144 may be provided at a pressure of about 1000 psia to about 2500 psia, such as about 1200 psia.

The water or steam provided in the water line 144 may be used for various purposes, such as powering steam powered turbines, and the like. Therefore, the system 50 may provide not only the gas from the gasification of the coal or other appropriate product, but may also provide super heated steam for export to various other generative prophecies. Again this may increase the efficiency of the system 50 or a plant efficiency, including the system 50.

The material provided in the gas line 116 from the system 50 may be used for various appropriate purposes. The material in the line 116 may be synthesis gas, which can be used to synthesize or form various products, such as petroleum or other materials that may be used for various powering purposes. Regardless, the system 50 generally operates without forming a liquid slurry, such as a water slurry of the coal from the hopper 52. Also the substantially dry slurry that is formed with the $CO_2$ allows for a substantially high percentage of CGE. With the high pressure system and the substantially dry slurry, the percentage CGE of the system 50 may be greater than about 90% and greater than about 93%. It will be understood that various techniques for determining efficiencies and formulating systems are generally known in the art and are used to determine final efficiencies in systems. For example a program, including computer code, may be used to calculate and verify kinetics in systems to ensure proper reaction times and volumes includes the article *K. M. Sprouse. Modeling Pulverized Coal Conversion in Entrained Flows*, AIChE Journal, v. 26, p. 964 (1980). Also, generally known programs may be used to assist in determining chemical and system equilibriums and thermodynamics, such as Gordon, S. and McBride, B. J. *Computer Program for Calculation of Complicated Chemical Equilibrium Composition and Application*, NASA Ref. Pub. 1311, Glen Research Ctr., Cleveland, Ohio, (1994). Thus one skilled in the art will understand that systems may be modeled with generally accepted techniques to determine outcomes of systems, such as those described above.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A system to produce a gaseous product from a solid starting material, comprising:

a first gasification subsystem;

a second gasification subsystem; and a pump system connected in parallel and in series with the first gasification subsystem and the second gasification subsystem for providing a volume of the solid starting material to the first gasification subsystem and the second gasification subsystem, the pump system being operable to form a dry slurry of the solid starting material with a slurry material; and a cyclone separator interconnecting said first gasification subsystem and said second gasification subsystem;

wherein said cyclone separator removes a volume of a solid material from a stream of gas produced by said first gasification subsystem prior to the stream passing to said second gasification subsystem;

wherein said pump system increases a pressure of the solid starting material to a pressure greater than an ambient pressure.

2. The system of claim 1, wherein said first gasification subsystem includes a product having a temperature of at least 1200° C.

3. The system of claim 1, wherein said second gasification subsystem includes a product having a temperature less than about 870° C.

4. The system of claim 1, wherein the starting material includes a solid carbonaceous material.

5. The system of claim 1, wherein the starting material comprises at least one of coal, petcoke, char, previously processed coal, or previously processed petcoke.

6. The system of claim 1, further comprising:

a cooling system;

wherein said cooling system is positionable to cool said cyclone separator to maintain a structural integrity of said cyclone separator.

7. The system of claim 6, wherein said cooling system includes an active cooling system including a coolant to absorb thermal energy in said cyclone separator.

8. The system of claim 7, wherein said coolant includes water operable to be provided to at least one of said first gasification subsystem or said second gasification subsystem to assist in the gasification of the solid starting material.

9. The system of claim 1, wherein said solid starting material in said pump system is at a pressure of at least about 500 psi.

10. The system of claim 1, wherein said slurry material includes gaseous carbon dioxide.

11. The system of claim 1, further comprising a starting material recycling system connected between an outlet of the second gasification subsystem and an inlet of the first gasification subsystem.

12. The system of claim 11, wherein said starting material recycling system includes a pump operable to move a processed portion of the starting material to said first gasification subsystem.

13. The system of claim 1, further comprising:

a heat exchanger operable to cool a product produced by said second gasification subsystem.

14. The system of claim 13, wherein said heat exchanger includes a liner formed of a ceramic matrix composite;

wherein a coolant is operable to pass through said liner.

15. The system of claim 1, wherein said each of said first gasification subsystem and said second gasification subsystem include an internal heat shield.

16. The system of claim 15, wherein said heat shield includes an active cooling system including a liner formed of a ceramic matrix composite positioned in said first gasification subsystem and said second gasification subsystem; wherein a coolant is operable to flow through said liner.

17. The system of claim 1, further comprising: a synthesis subsystem operable to form a selected product from a preliminary product formed from said second gasification subsystem.

18. The system of claim 13, wherein the heat exchanger is directly fluidly connected with an outlet of the second gasification subsystem.

19. The system of claim 13, wherein the heat exchanger is directly fluidly connected with an outlet of the first gasification subsystem.

20. The system of claim 13, wherein the heat exchanger is directly fluidly connected with an outlet of the cyclone separator.

21. The system of claim 13, wherein the heat exchanger is directly fluidly connected with each of an outlet of the first gasification subsystem, an outlet of the second gasification subsystem, and an outlet of the cyclone separator.

22. The system of claim 1, further comprising a starting material supply for providing the solid starting material to the first gasification subsystem.

23. The system of claim 12, wherein the starting material recycling system further includes a collector and a filter located upstream from the pump.

24. A gasification system comprising:

a high temperature gasifier for operating at a first temperature;

a low temperature gasifier for operating at a second temperature that is lower than the first temperature, the low temperature gasifier being located downstream from the high temperature gasifier;

a pump system connected in parallel and in series with the high temperature gasifier and the low temperature gasifier; and a cyclone separator connected between the high temperature gasifier and the low temperature gasifier.

25. The gasification system of claim 24, wherein the first temperature of the high temperature gasifier includes a temperature range of at least 1200° C. and the second temperature of the low temperature gasifier includes a temperature range that is less than about 870° C.

26. The gasification system as recited in claim 24, wherein the low temperature gasifier and the high temperature gasifier are each mounted directly to the cyclone separator.

27. The gasification system as recited in claim 24, further including a heat exchanger that is fluidly connected with the low temperature gasifier.

28. The gasification system as recited in claim 27, wherein the heat exchanger is fluidly connected with the high temperature gasifier.

29. The gasification system as recited in claim 28, wherein the heat exchanger is fluidly connected with the cyclone separator.

* * * * *